United States Patent [19]

Osteen

[11] 4,137,484

[45] Jan. 30, 1979

[54] COLOR IMPROVEMENT OF HIGH PRESSURE SODIUM VAPOR LAMPS BY PULSED OPERATION

[75] Inventor: Mitchell M. Osteen, Zirconia, N.C.

[73] Assignee: General Electric Company, Schenectady, N.Y.

[21] Appl. No.: 806,301

[22] Filed: Jun. 13, 1977

Related U.S. Application Data

[63] Continuation-in-part of Ser. No. 649,900, Jan. 16, 1976, abandoned.

[51] Int. Cl.[2] ..... H05B 37/02; H05B 39/04; H05B 41/36

[52] U.S. Cl. ..... 315/209 R; 313/220; 313/227; 315/107; 315/105

[58] Field of Search ..... 315/209, 225, 47, 107, 315/362, 105; 313/220, 228, 229

[56] References Cited

U.S. PATENT DOCUMENTS

| | | | |
|---|---|---|---|
| 3,707,649 | 12/1972 | Kottenstette | 315/239 |
| 3,898,504 | 8/1975 | Akutsu et al. | 313/220 |
| 3,914,649 | 10/1975 | Hug | 313/228 |
| 4,052,636 | 10/1977 | Strok | 313/229 |

*Primary Examiner*—Saxfield Chatmon, Jr.

*Attorney, Agent, or Firm*—Ernest W. Legree; Lawrence R. Kempton; Frank L. Neuhauser

[57] ABSTRACT

High pressure sodium vapor lamps containing sodium or both sodium and mercury are raised in color temperature and improved in color rendition by pulse operation. During the pulse there is considerable enhancement and broadening of the sodium lines at 449, 467, 498 and 568 nm and the development of a continuum from 400 to 450 nms, and also the appearance of visible mercury lines in lamps containing mercury. Optimum results with lamps in size ratings from 50 to 1000 watts are obtained with pulse repetition rates from 500 to 2000 Hz and duty cycles from 10 to 35%. The color temperature may be increased from the common value of 2050° K to 2500° K with reduction in lamp efficacy of only about 20% from conventional 60 Hz operation. Even higher color temperatures may be obtained if further reduction of efficacy is acceptable.

39 Claims, 9 Drawing Figures

21
22
20
18
14
11
1
15
2
19
9
13
16
10
+
12
17
5
6
4
7
3
8
BALLAST
31
32
PULSE GENERATOR
28
27
ELECTRONIC SWITCH
25
+
FULL WAVE RECTIFIER AND FILTER
26
240 VAC
30
29
WAVEFORM GENERATOR
−

CIE COORDINATES FOR VARIOUS FREQUENCIES AND PULSE WIDTHS
*Fig. 5*
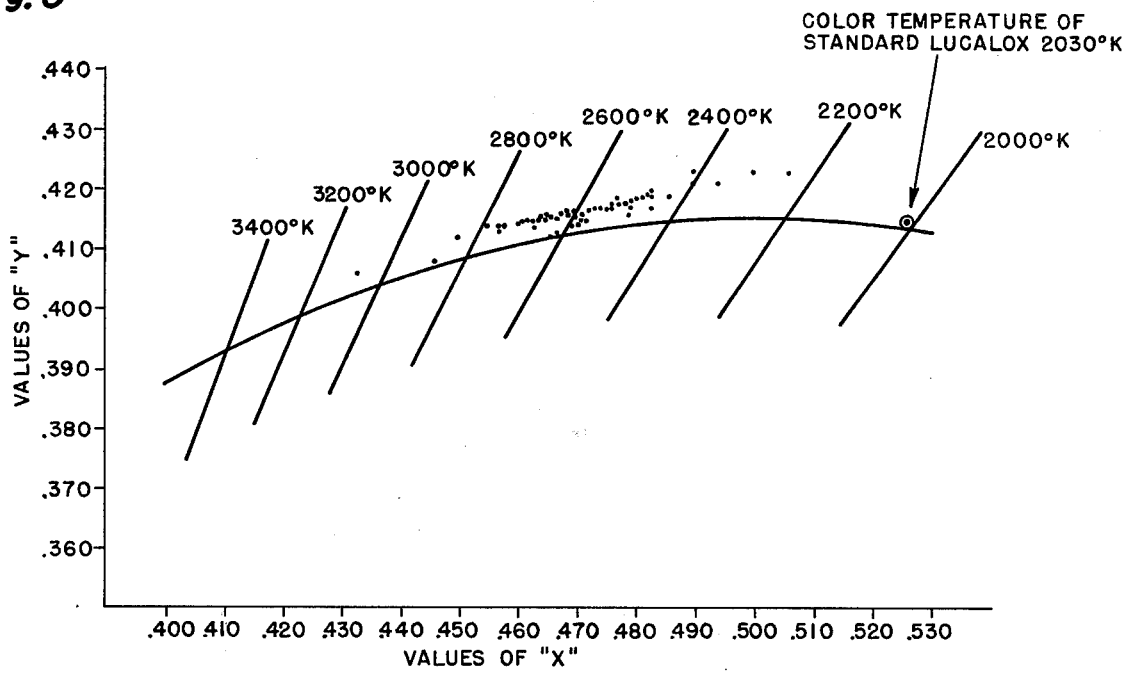
*Fig. 6* DEPENDENCE OF COLOR TEMPERATURE ON PULSE WIDTH AND PULSE PERIOD FOR CONSTANT AVERAGE INPUT POWER
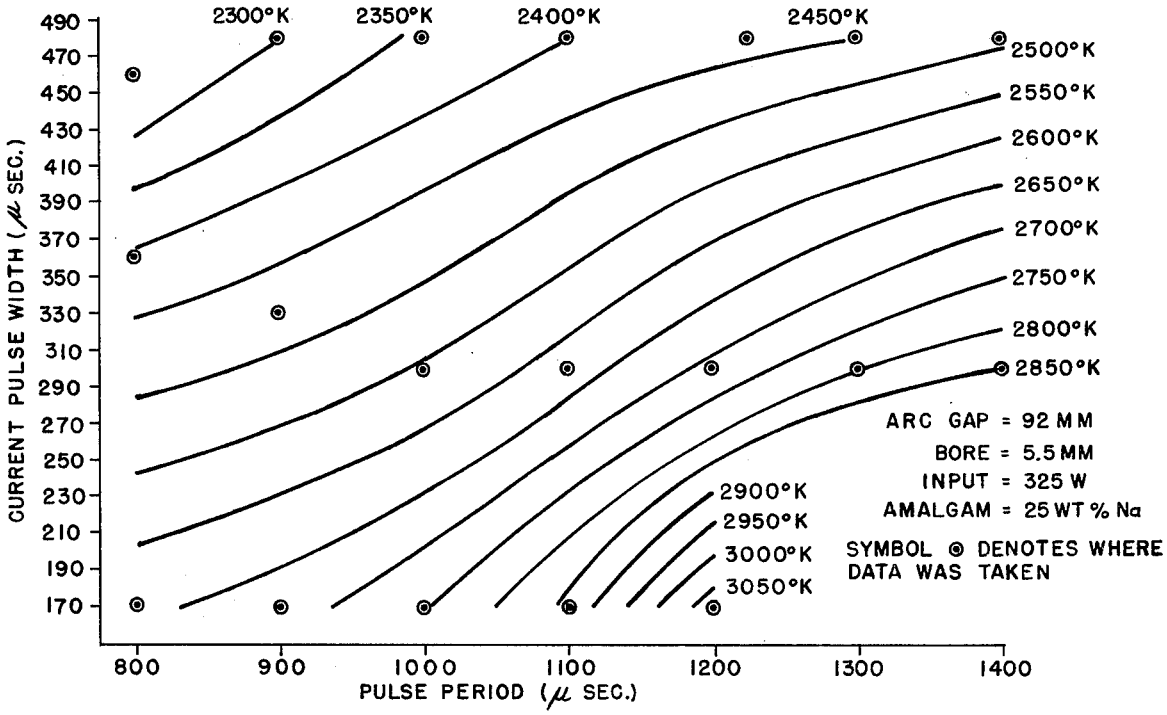

DEPENDENCE OF SODIUM LINES AND BLUE CONTINUUM ON PULSE PERIOD

DEPENDENCE OF SODIUM LINES AND BLUE CONTINUUM ON PULSE WIDTH

COLOR IMPROVEMENT OF HIGH PRESSURE SODIUM VAPOR LAMPS BY PULSED OPERATION

The present application is a continuation-in-part of my copending application Ser. No. 649,900, filed Jan. 16, 1976 and now abandoned.

The invention relates to high pressure sodium vapor lamps and is concerned with an improved system and method of operating such lamps which makes possible a large increase in color temperature and better color rendition at the cost of a minor reduction in efficacy.

BACKGROUND OF THE INVENTION

High pressure sodium vapor lamps are well known in the art and are widely used for street, roadway and area lighting applications. The lamps comprise an alumina ceramic tube which contains a charge of sodium or sodium plus mercury and is generally enclosed within an outer glass envelope or jacket. The lamps are conventionally operated on 60 cycle alternating current power by means of ballasts designed to limit the current and provide a power input not exceeding the lamp wattage rating.

The light generated by the discharge through the sodium or sodium plus mercury vapor is due almost exclusively to the excitation of the sodium atom through the self-reversal and broadening of the sodium D line at 589 nanometers. In those lamps containing mercury, the mercury serves as a buffer gas which raises the voltage gradient and thereby the efficacy but it is not excited to appreciable emission. The result is a lamp which is extremely efficient in terms of lumens per watt, for instance from 75 to 130 lumens per watt depending upon lamp size, efficacy increasing with size from 70 watts to 1000 watts. But the lamp is low in color temperature, from 2000° to 2100° Kelvin, and low in color rendition index, from 10 to 20. While object colors in all portions of the spectrum are recognizable, those at the "cool" end such as violets, blues, and to some extent greens are muted or grayed down. The lamp has proved suitable for most outdoor applications but is not generally acceptable for indoor applications, particularly where critical color discrimination is required.

It was recognized in U.S. Pat. No. 3,248,590 — Schmidt, that improved color rendition with the high pressure sodium vapor lamp could be achieved by going to higher sodium vapor pressure but at the price of a drop in efficacy. One line of attempts at improving the lamp's color temperature and rendition has been along the course suggested by Schmidt, namely raising the sodium vapor pressure, by one means or another. For instance U.S. Pat. No. 3,716,743 — Mizuno et al, proposes to do so by heat shields about the lamp ends. Raising the sodium vapor pressure is similar to overwattaging the lamp, that is, operating it above its design rating; by so doing the color temperature may be raised but at the cost of a loss of about 10 lumens per watt in efficacy for each 100° K. gain in color temperature 2100° K. Also overwattaging can greatly accelerate sodium loss which leads to short term voltage rise and outer jacket darkening, and thus short life.

Other attempts at improving color temperature and rendition involved the addition of other elements to the lamp fill. For instance U.S. Pat. No. 3,521,108 — Hanneman, proposed the addition of cadmium and optionally thallium to the sodium and mercury. None of these attempts up to the present has resulted in a lamp or lighting system which is a practical commercial product because the improvements were minor or outweighed by the concomitant disadvantages.

SUMMARY OF THE INVENTION

The general object of the invention is to provide a lighting system and method for operating high pressure sodium vapor lamps in a manner achieving higher color temperature and improved color rendition with only minor loss in efficacy and substantially without reduction of lamp life.

The metal fill of the conventional high pressure sodium vapor lamp contains sodium and usually mercury but the mercury radiation produced by the discharge is insignificant. The invention is based upon the discovery that in the time interval during and immediately following the application of a wave front having a rapid rise to the lamp, the higher electronic states of sodium are excited to substantial emission, and in lamps containing mercury, radiation from mercury also appears. During pulse operation of the lamp, emission from several sodium lines and a continuum in the blue-green portion of the spectrum becomes substantially more intense. In addition, the normal light in the yellow-red portion of the spectrum which is due to self-reversal and broadening of the sodium D lines is partially suppressed. As a result, an increase in color temperature and an improvement in color rendition index takes place.

There must be little or no power input between pulses, since a "keep-alive" current maintains plasma ionization and eliminates the unique characteristic observed on pulsing. Pulses may be utilized having repetition rates above 500 and up to about 2000 Hz and duty cycles from 10 to 35%. By so doing the color temperature may readily be increased in excess of 400° K., that is from about 2050° K. up to about 2500° K. with only about 20% reduction in efficacy over conventional a.c. operation and without any appreciable reduction in lamp life. Color temperature may be raised considerably beyond 2500° K. if further reduction of efficacy is acceptable.

DISTINCTION FROM PRIOR ART

In lamps wherein efficacy or spectral quality rise with loading but wherein the envelope material or other structural features impose a limit on the average loading which the lamp can withstand, it is well-known to resort to pulse operation. By means of a pulsed wave form, a high instantaneous loading may be achieved while maintaining the average energy input into the lamp within a rated level. An early example of a lamp and circuit combination for so doing is described in U.S. Pat. No. 2,938,149 — Wiley, Pulse Circuit for Arc Lamp (1960), and a more recent example is given in U.S. Pat. No. 3,624,447 — Young et al., Method of Operating a High Pressure Gaseous Discharge Lamp With Improved Efficiency (1971). In these systems, pulse operation is simply a means for achieving high instantaneous loading at low average input. The time duration of the pulses is not important providing it is short enough that the overall lamp temperature does not rise appreciably during a single pulse. Accordingly such pulsing has been at low frequencies, usually at 60 Hz corresponding to the common power line frequency, or at 120 Hz where a pulse is generated on each half cycle of line frequency. By shortening the duty cycle, that is the ratio of on-time to off-time during a period, the instantaneous loading is increased in inverse ratio. Parameters typical of such circuits are a 120 Hz repetition rate whose period is 8333 microseconds and a 20% duty cycle corresponding to an on-time of 1667 ms, and power input adequate to maintain ionization of the plasma between pulses. Such parameters would not achieve the mode of operation of the present invention.

The present invention uses pulsing to realize a different effect heretofore unknown and which requires much shorter pulse periods or on-times. Blue-green sodium lines, a blue continuum from the highly excited states of sodium, and mercury lines in lamps containing mercury rise to a high intensity as the current pulse wave front is applied. Within approximately 100 μsec this radiation, which may be referred to as upper level radiation, begins to decay, even though the current is maintained at a high level. The visible mercury lines decay away even more rapidly than the upper level sodium radiation. The broadened and reversed sodium D line radiation on the other hand builds up throughout the pulse duration and does not begin to decay until the pulse is terminated. Its decay rate is slower than that for the upper level sodium or mercury radiation. The rise in color temperature and improvement in color rendition index is associated with the increased emission from blue-green sodium lines, blue sodium continuum radiation, and mercury line excitation relative to yellow-red sodium D line radiation which occurs for pulse on-times not exceeding about 500 μsec. Longer pulse durations greatly diminish color improvement by allowing the plasma to relax to a nearly steady state condition during the current pulse.

The prior art also used a keep alive current flowing through the lamp between pulses, typically 15% of the average current. In this invention, a keep alive current is destructive of the highly excited sodium and mercury radiation on which the color improvement depends and is to be avoided.

DESCRIPTION OF DRAWING

In the drawing:

FIG. 5 is a graph showing the C.I.E. color coordinates of a lamp for various pulse frequencies and pulse widths at constant input power.

FIG. 6 shows the dependence of color temperature on pulse width and pulse period at constant power input.

DETAILED DESCRIPTION

Figure 1:
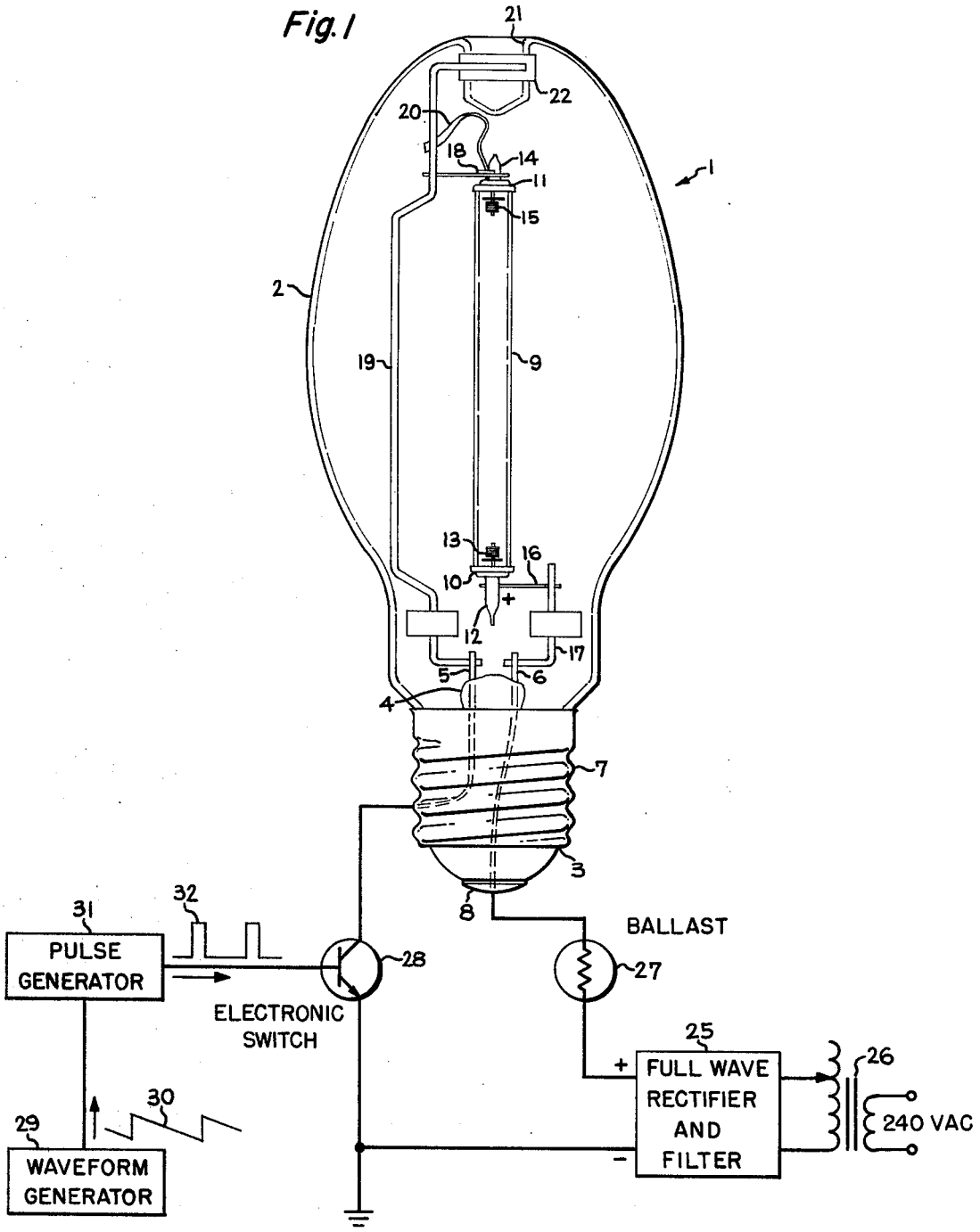
FIG. 1 is a side view, partly in section, of a conventional high pressure sodium vapor discharge lamp combined with a block diagram of a circuit suitable for pulse operating the lamp.

Referring to FIG. 1, the illustrated high pressure sodium vapor lamp 1 is typical of the lamps that can be advantageously pulse-operated for color improvement according to the concepts of the present invention. Generally similar lamps are manufactured in a variety of sizes ranging from 70 to 1000 watts. The lamp comprises an outer envelope 2 of glass to the neck of which is attached a standard mogul screw base 3. The outer envelope comprises a re-entrant stem press 4 through which extend, in conventional fashion, a pair of relatively heavy lead-in conductors 5,6 whose outer ends are connected to the screw shell 7 and eyelet 8 of the base.

The arc tube 9 centrally located within the outer envelope comprises a length of alumina ceramic tubing. It may be polycrystalline ceramic which is translucent or single crystal alumina or synthetic sapphire which is clear and transparent. End closures consisting of metal caps 10, 11 of niobium which matches the expansion coefficient of alumina ceramic, are sealed to the ends of the tube by means of a glassy sealing composition. End cap 10 has a metal tube 12 sealed through it which serves as an exhaust and fill tubulation during manufacture of the lamp. The exhaust tube is sealed off at its outer end and serves as a reservoir in which excess sodium metal or sodium mercury amalgam condenses during operation of the lamp, the illustrated lamp being intended for base-down operation. Electrode 13 within the lamp is attached to the inward projection of exhaust tube 12 and a dummy exhaust tube 14 extending through metal end cap 11 supports the other electrode 15. By way of example, the arc tube contains a filling of xenon at a pressure of about 30 torr for a starting gas and a charge of 25 milligrams of amalgam of 25 weight percent sodium and 75 weight percent mercury.

Exhaust tube 12 is connected by connector 16 and short support rod 17 to inlead conductor 6 which provides circuit continuity to eyelet 8 of the base. Dummy exhaust tube 14 extends through a ring support 18 fastened to side rod 19 which provides lateral restraint while allowing axial expansion of the arc tube. A flexible metal strap 20 connects dummy exhaust tube 14 to side rod 19 which in turn is welded to inlead conductor 5, thereby providing ciruit continuity to base shell 7. The distal end of side rod 19 is braced to inverted nipple 21 in the dome end of the envelope by a clip 22 which engages it.

CONVENTIONAL 60 HZ OPERATION

This known lamp is normally operated by a conventional ballast comprising windings on an iron core from a 60 cycle alternating current power supply. Some ballasts contain a special circuit for generating a high voltage low energy pulse to ignite the lamp. For instance present specifications for the 400 watt lamp call for a 1 μsec long pulse of minimum 2250 volts amplitude applied at least 50 times a second. Once the lamp starts, the pulsing circuit is automatically shut off and the pulses do not enter the prolonged or steady state operation of the lamp.

Some high pressure sodium vapor lamps are started by means of a snap switch inside the outer envelope, a scheme favored by some European manufacturers. At rest the switch short circuits the lamp, and when the lamp is energized, a heating element causes the switch to open allowing the inductive surge from the ballast to initiate the arc. Other lamps utilize neon or a Penning mixture of neon with a very small percentage of argon rather than xenon as the starting gas. This lowers the starting voltage particularly when used in combination with heating elements or capacitive electrodes external to the arc tube.

Figure 2:
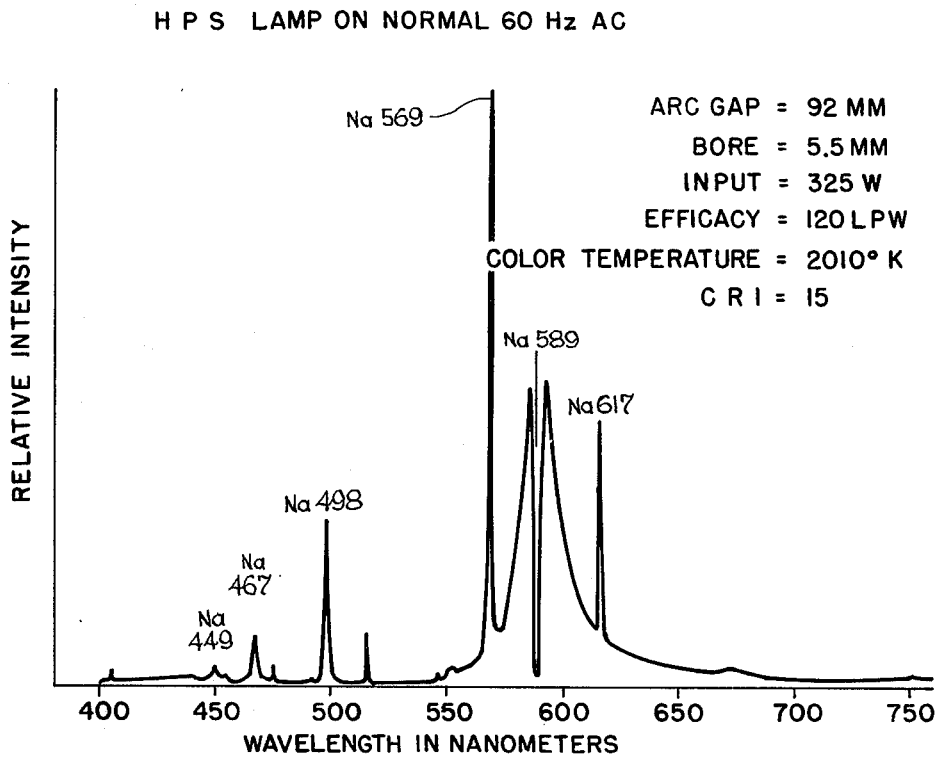
FIG. 2 shows the spectrum of the lamp under normal alternating current operation.

In conventional a.c. operation, when the lamps are first turned on, the xenon and mercury produce a blue-white glow in the arc tube. As the sodium is vaporized by the generated heat, the light turns first to monochromatic yellow and then gradually to white having a golden or orange cast, full warm-up taking about a minute. Penning mixture lamps first emit a red light due to their neon starting gas but this changes to the usual color as warm-up continues. A spectrum typical of the lamp of FIG. 1 after warm-up and corresponding to a 325 watt size is illustrated in FIG. 2; the color temperature is 2010° K. color rendition index 15, and efficacy 120 lumens per watt. The light is due primarily to the broadened wings on either side of the self-reversed yellow sodium D lines at 589 nanometers and secondarily to the sodium lines such as those at 569, 498 and 617 nanometers. Notwithstanding that the metal fill of the lamp can contain more mercury than sodium, mercury radiation is insignificant. The first excitation potential of the sodium atom at 2.1 volts is much lower than the first excitation potential of the mercury atom at 4.9 volts or the higher excited states of sodium at 4 to 5.1 volts. Under these circumstances the weakness of the sodium radiation other than the D lines and absence of mercury radiation may be explained by a plasma in local thermodynamic equilibrium where the plasma temperature is too low to substantially excite states above 2.1 volts. The function of the mercury in lamps containing mercury is simply to serve as a buffer gas which raises the voltage gradient of the arc. This enables the lamp and also its associated ballast to operate more efficiently at a higher voltage drop with a lower current.

The efficacy of conventional high pressure sodium lamps increases in general with the lamp size or rating; for instance in a 150 w size, it is 101 lpw; in a 400 w size, 120 lpw; and in a 1000 w size, 130 lpw. However there is little variation in color temperature which is generally from 2000 to 2100° Kelvin, or in color rendition index which is generally from 10 to 20.

OVERWATTAGING

Figure 3:
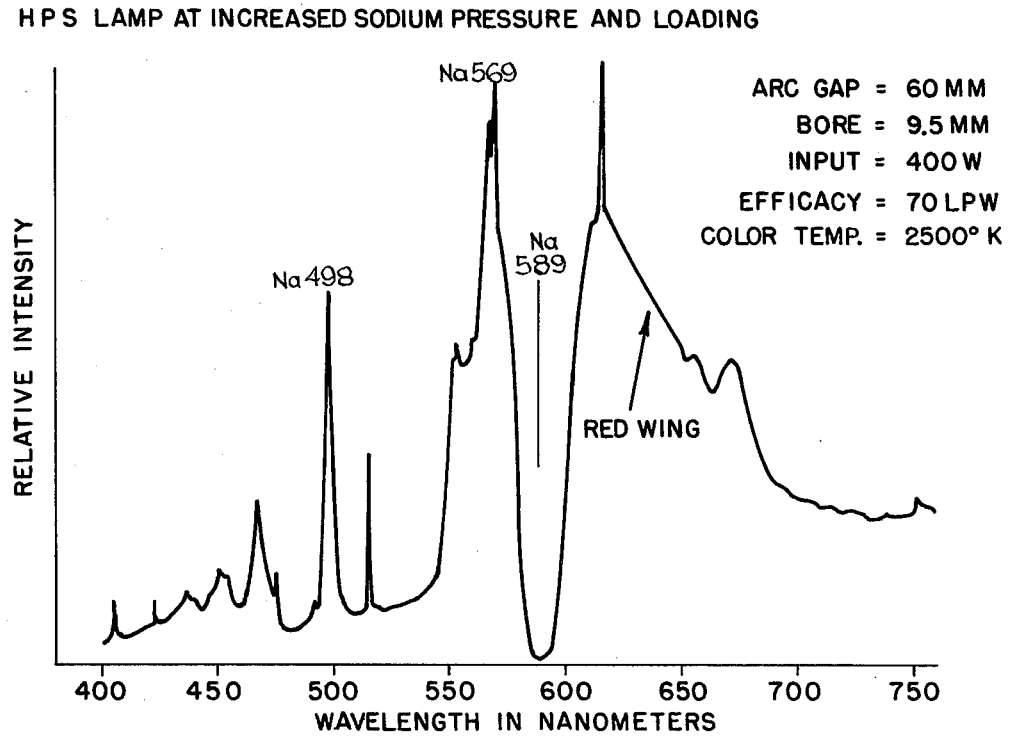
FIG. 3 shows the typical spectrum of a high pressure sodium lamp when it is overwattaged and the sodium pressure is increased.

The effect of overwattaging, that is operating the lamp well above its design rating whereby a higher vapor pressure is achieved is typically illustrated by the spectrum of FIG. 3. Except for a larger bore and shorter arc gap the lamp is similar to that used to produce the spectrum of FIG. 2 but it is operated at an input of 400 watts on 60 Hz a.c. as against an input of 325 watts in the former case. Also heat was applied to the cold spot to raise the partial vapor pressure of sodium up to about 300 torr, resulting in more broadening of the wings of the self-reversed sodium D lines. The color temperature is increased to 2500° K. but the efficacy is only 70 lumens per watt. The low efficacy is due in large part to the rise of the wing on the long wavelength side of the D line, the so-called red wing. Radiant energy in this area is of decreasing value for lighting, and any energy beyond 700 nm is in the infrared and useless for lighting. Since overwattaging, in addition to reduced efficiency, entails accelerated sodium loss leading to voltage rise, outer jacket darkening, and short life, it is not an acceptable way to raise color temperature.

PULSE OPERATION

Pulse operation according to the invention has the unexpected result of exciting high energy states of sodium not normally important in conventional discharges, as well as mercury in those lamps containing mercury. The effect may be demonstrated and studied using the equipment and circuit arrangement shown in FIG. 1. The power supply is a full wave rectifier and filter 25 energized from a 240 volt, 60 cycle a.c. supply through a variable transformer 26. Lamp 1 is connected in series with a resistive ballast 27 and an electronic switch 28 across the d.c. supply with the polarity indicated. For convenience, two 1000 watt incandescent lamps connected in parallel were used for ballast 27. The electronic switch is represented as a simple transistor having its emitter-collector path connected in series with the lamp and its base supplied with control signals, but any electronic equipment capable of turning on and shutting off current flow from source 25 in a controlled manner may be used. A waveform generator 29 producing sawtooth voltages 30 triggers a pulse generator 31 which supplies rectangular pulses 32 to turn on transistor 28. During the time interval while the transistor is on, the voltage of source 25 is applied across the lamp and ballast combination, and its magnitude is controlled through variable transformer 26. The equipment permits the frequency or pulse repetition rate, the pulse duration and the pulse amplitude to be controlled at will. Suitable instruments, not shown, are used to measure or indicate instantaneous voltage, current and waveform, to measure power input and to measure and analyze the lumen output.

Figure 4:
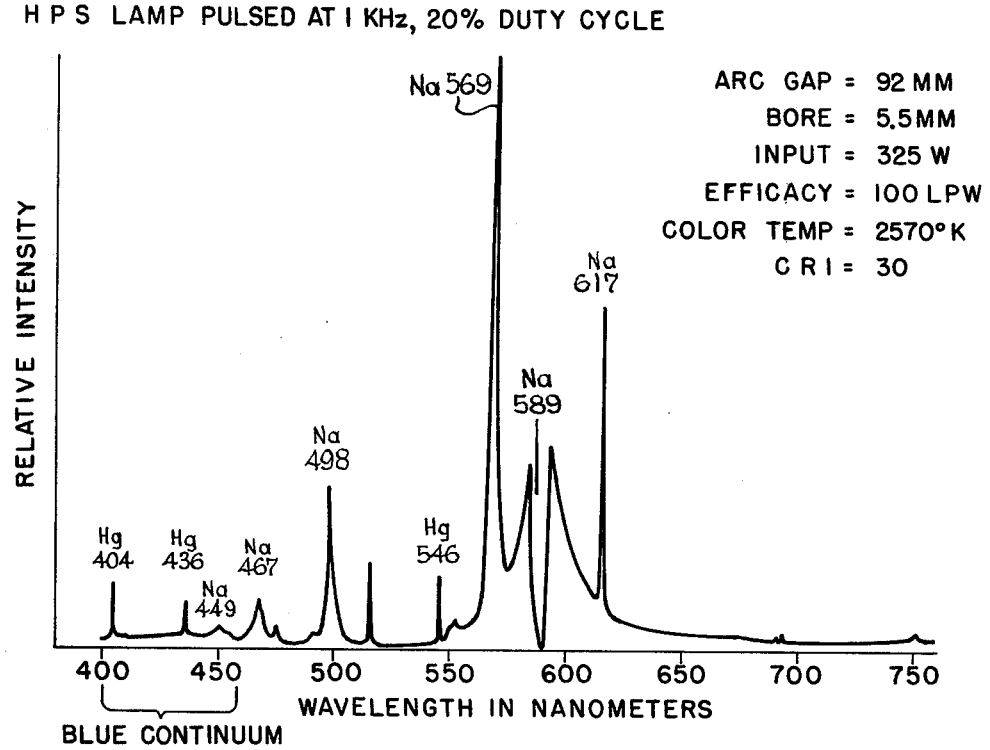
FIG. 4 shows the spectrum of the lamp of FIG. 2 under pulse operation in accordance with the invention.

It was first observed that pulse operation at sonic frequencies such as 1000 Hz produced an improvement in color. By contrast, pulse operation at power line frequencies such as 60 cycles did not. A typical spectrum is shown in FIG. 4. The sodium red wing is hardly changed at all relative to the conventional 60 Hz operation represented in FIG. 2. The really startling feature is the strong enhancement of the sodium lines on the blue side of the spectrum such as those at 449, 467, 498 and 568 nms and the previously insignificant continuum beginning in the blue end of the visible spectrum and extending to about 450 nms. In lamps containing mercury the mercury lines at 404, 436 and 546 nms also contribute to the improved color. Such enhancement of lines in the blue and green and of a continuum at the blue end of the spectrum in a sodium discharge without the presence of a prominent red wing is a new phenomenon which has never previously been observed. It makes possible high color temperature with only minor reduction in efficacy.

Prior to the filing of the parent case of this application, a study of pulse repetition rates between 670 and 2000 Hz and of duty cycles between 15% and 30% was made using the pulsing circuit shown schematically in FIG. 1. That circuit, using a power transistor as an electronic switch, generated pulses having very steep rise and fall represented by the rectangular pulses 32 in the drawing. The time duration of those pulses was measured as the interval between the substantially vertical rise and fall lines and this presented no problem.

The original circuit was not designed for efficiency and was limited to about 200 watts output; in this continuation-in-part case, a different more efficient circuit has been used to facilitate a repeat study on larger sizes of lamps. The present circuit uses an SCR, that is a rectifier having a control electrode, to discharge a capacitor through the lamp in series with an inductor. This circuit is intended for commercial pulse operation of lamps, and is disclosed and claimed in application Ser. No. 743,566, Neal, filed Nov. 22, 1976, titled Pulse Circuit for Gaseous Discharge Lamps and similarly assigned. The lamp current wave form which it generates resembles a series of discrete half sine wave pulses at spaced intervals. Their time duration has been taken as 3/2 times the pulse width at half height and the measurements on which the results presented in FIGS. 2 to 9 are based were taken in this way. Comparison of results previously obtained by rectangular pulses with those now obtained by quasi half sine pulses show the same trends. Thus when the repetition rate is increased, the color temperature goes up in the same way. However it has been observed that in order to achieve the same results as rectangular pulses in the range of duty cycle from 10 to 30%, the quasi half sine pulses' range of duty cycle extends from 10 to 35% approximately.

In the repeat study, the average power input to the arc tube was maintained at 325 watts which kept the sodium partial pressure at about 60 torr which is near optimum for luminous efficacy. The corresponding partial pressure of mercury for a 25 weight percent sodium, 75 weight percent mercury charge is approximately 200 torr. The resulting C.I.E. (Commission Internationale d'Eclairage) color points for each experimental condition are plotted in FIG. 5 as solid dots. Each solid dot, of which there are in excess of 50, represents a different combination of pulse repetition rate or frequency, and of pulse width or on-time. All the pulsed lamp points lie close to the blackbody curve which is the color locus of a cavity radiator over the same temperature range, and extend well beyond 2500° K. color temperature. The color point for a similar lamp, identified standard Lucalox, conventionally operated on 60 cycle alternating current is also indicated for reference and corresponds to 2030° K.

The observed values of correlated color temperature may be described in terms of the peak current, pulse on-time, and time between consecutive pulses. Considering a series of rectangular pulses applied to a lamp, if the peak current be denoted by I, the pulse width by $t_1$, and the time between consecutive pulses by $t_2$, and if constant lamp voltage V during pulses be assumed, the energy delivered to the lamp during each pulse is $I.V.t_1$. Therefore, average lamp power P is given by $$P = I.V.t_1/t_2 \qquad \text{Eq. 1}$$

Where the average power is maintained constant while varying pulse on-time and pulse off-time in order to avoid changing arc tube wall loading and amalgam cold spot temperature, I, $t_1$ and $t_2$ are related by the foregoing equation so that any two of these three variables are adequate to describe observed color temperature variations. By choosing pulse width $t_1$ and pulse period $t_2$ as the variables, the relationship shown graphically in FIG. 6 is obtained indicating that for a constant average power input to the lamp, color temperature increases with increasing pulse period and/or with decreasing pulse width. Also at constant power input, highest color temperature is achieved by maximum peak arc tube current. However, the data tend to show that improved color is at the expense of some reduction in efficacy and that there is a trade-off between the two, so to speak. Where efficacy has to be considered, it follows that unlimited increase in peak current does not lead to optimum lamp performance.

Figure 7:
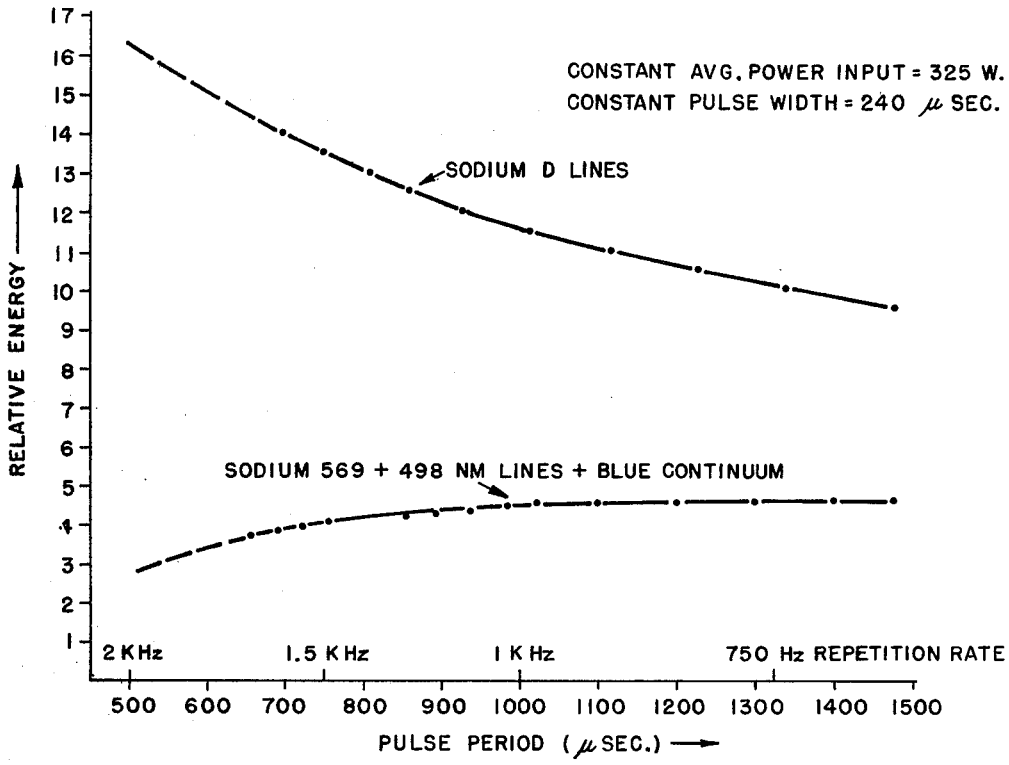
FIG. 7 shows qualitatively the behavior of the intensity of sodium D-line and continuum radiation as a function of pulse repetition rate for fixed pulse width.

In FIG. 7 the intensity of the self-reversed and broadened sodium D lines and the relative intensity of blue continuum radiation plus the blue-green sodium lines at 569 and 498 nanometers are plotted, for the condition of constant average input wattage and fixed pulse width, against pulse repetition rate or frequency to indicate the pattern. It is seen that the blue and green radiation increases while the yellow and red sodium D line intensity decreases towards the lower frequencies.

Figure 8:
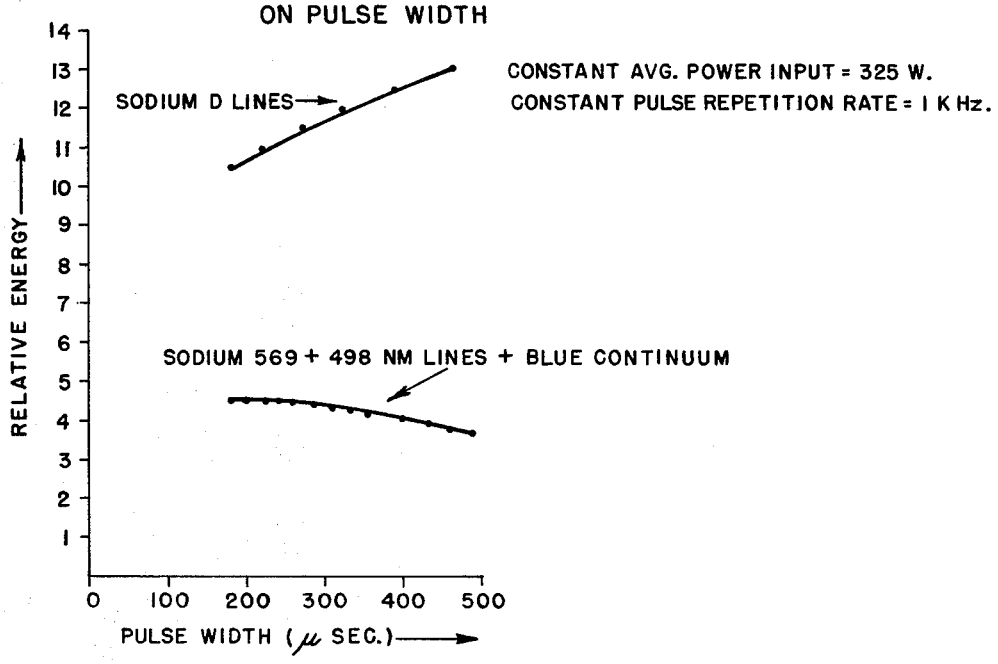
FIG. 8 shows qualitatively the behavior of the intensity of sodium D line and continuum radiation as a function of pulse width for fixed pulse repetition rate.

If the pulse frequency or repetition rate is held constant, peak current varies inversely with pulse width or duty cycle. The pattern is represented in FIG. 8 wherein the relative intensities of the broadened sodium D line and that of blue continuum radiation plus blue and green sodium lines for constant average input wattage and fixed frequency are plotted against pulse width. It is seen that the blue and green radiation intensity increases while the yellow and red sodium D line intensity decreases towards the narrower pulse widths.

The information contained in FIGS. 7 and 8 shows that pulsing for color improvement effects a shift in radiation output balance toward the shorter visible wavelengths. It is observed that the gain in blue and green radiation is less than the concomitant loss in D line radiation, confirming that the color improvement is at the expense of some efficacy.

Figure 9:
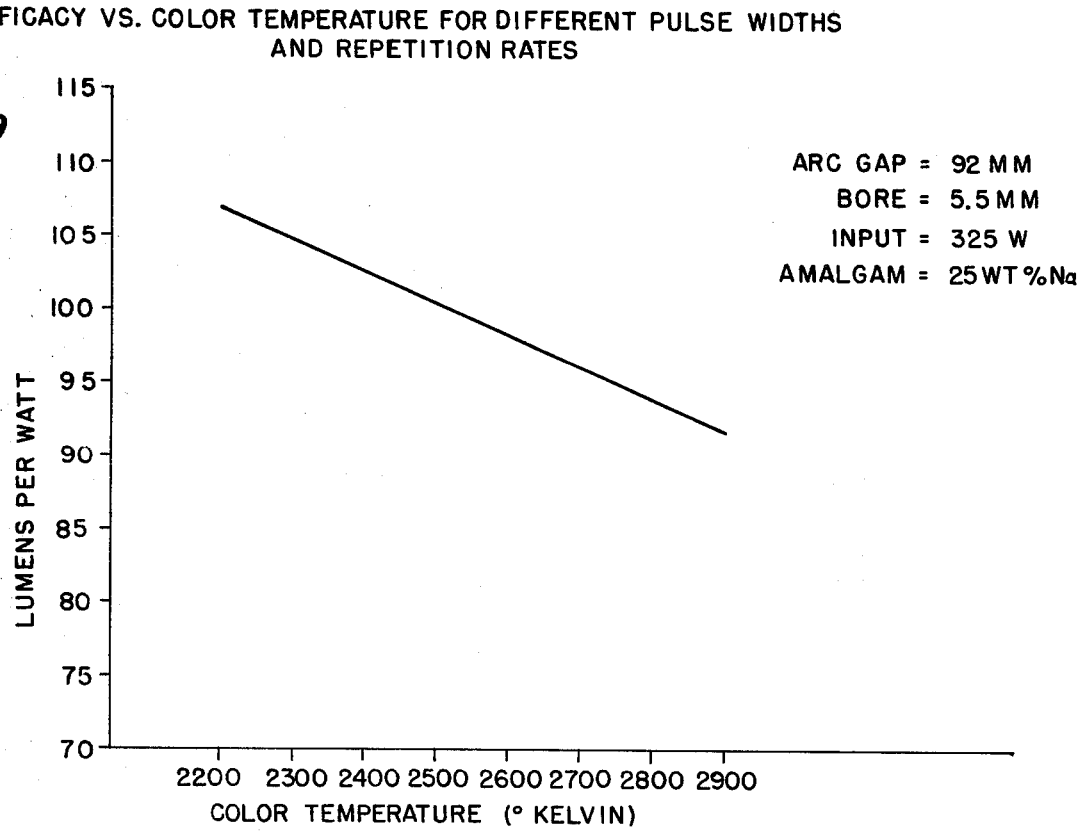
FIG. 9 is a graph correlating color temperature with lamp efficacy for different pulse frequencies and duty cycles.

The plot of FIG. 9 shows the relationship between gain in color temperature and reduction in efficacy, which may be termed the color temperature — efficacy trade-off, for the lamp whose spectrum is shown in FIG. 4, at various pulse widths and pulse repetition rates. All combinations of pulse width and repetition rate fall on a line whose slope corresponds to a loss of approximately 2 lumens per watt for each gain of 100° K. in color temperature. Further increase in color temperature at the expense of efficacy is possible but it becomes increasingly unfavorable beyond 3000° K. Another way of increasing the color temperature further is to increase the sodium vapor pressure as by overwattaging while pulsing, but such increase would be at the cost of a further loss in lamp efficacy.

The present lamp, pulse-operated in accordance with the invention has an efficacy better than 100 lumens per watt at 2500° K. By contrast, to raise the color temperature to 2500° K. by the prior art method of increasing the sodium vapor pressure as by overwattaging but without pulsing entailed an efficacy of barely 70 l.p.w. coupled with poor maintenance and shortened life. By using for the arc tube chemically polished alumina tubing whose better light transmission translates into a 4 to 5% gain in light output, and by avoiding the use of a barium flash getter which, by forming a coating in the outer envelope, may cause a 1 to 2% loss, an efficacy reduced less than 15% from conventional may be achieved at a color temperature of 2600° K.

The foregoing data has been obtained using unidirectional pulses, primarily because the power supply or pulsing equipment required is simpler than that needed for bidirectional pulses. In unidirectional pulsing, it is desirable to have the exhaust tube 12 serving as the cold-spot reservoir of sodium-mercury amalgam lowermost when it is operated vertically, as shown in FIG. 1. Electrode 13, the anode, is also at the cold-spot end and this is desirable in order to avoid color separation wherein one end of the arc tube is bluer than the other due to sodium starvation. The cathode 15 is of course activated for efficient electron emission, but the anode 13 need not contain any electron-emitting material. In fact it is preferable on unidirectional pulsing for the anode not to be activated because activation promotes wall-darkening.

In bidirectional pulsing, the spectral results are substantially the same as with unidirectional pulsing. Of course a lamp must be used having cathodes, that is, activated electrodes at both ends.

As previously stated, a keep-alive current is destructive of the improved emission in the blue-green on which the rise in color temperature depends. Therefore a keep-alive current should preferably be avoided altogether. If any must be used due to economy requirements in the design of a pulsing power supply, it should be kept to the absolute minimum.

What I claim as new and desire to secure by Letters Patent of the United States is:

1. A method of operating a high pressure metal vapor lamp of a kind having a filling of sodium within an envelope provided with spaced electrodes and proportioned to produce, at a rated power input, a sodium vapor pressure causing self-reversal and broadening of the sodium resonance D lines which method comprises:

energizing said lamp by electrical pulses producing approximately said rated power input, said pulses having a rise rapid enough and a time-duration short enough to produce, in addition to the light resulting from the self-reversal and broadening of the sodium D lines, substantial light in the blue-green side of the spectrum whereby the color temperature is increased.

2. The method of claim 1 wherein the time-duration of the pulses is short enough that the light on the blue-green side of the spectrum which is emitted immediately following the start of a pulse is a substantial portion of the light produced by the lamp.

3. The method of claim 1 wherein the pulses are so proportioned in time-duration and current-amplitude that the light emitted on the blue-green side of the spectrum immediately following the start of a pulse is a substantial portion of the light produced by the lamp and no appreciable rise in the red wing of the sodium D lines is produced.

4. The method of claim 1 wherein the current-amplitude of the pulses is large enough to cause substantial production of light in the blue-green side of the spectrum whereby the color temperature is increased.

5. The method of claim 1 wherein the current-amplitude of the pulses is large enough to cause substantial production of light in the blue-green side of the spectrum accompanied by suppression of light in the yellow red side of the spectrum whereby the color temperature is increased.

6. The method of claim 1 wherein the current-amplitude of the pulses is large enough to cause substantial emission of lines by highly excited sodium atoms and a continuum in the blue-green.

7. The method of claim 1 in operating a lamp of the given kind containing mercury in addition to sodium wherein the current-amplitude of the pulses is large enough to cause substantial emission of lines by highly excited sodium atoms and by mercury atoms and a continuum in the blue-green.

8. The method of claim 1 wherein the pulses are short enough in time-duration to produce sufficient light in the blue-green side of the spectrum to raise the color temperature to at least 2300° K.

9. The method of claim 1 wherein the pulses have a time-duration and a current amplitude achieving a rise in color temperature of at least 400° K. over the color temperature of the lamp under conventional operation at said rated power, and an efficacy not substantially lower than 20% below said conventional operation.

10. A method of operating a high pressure metal vapor lamp of a kind having a filling of sodium within an envelope provided with spaced electrodes and proportioned to produce, at a rated power input, a sodium vapor pressure causing self-reversal and broadening of the sodium resonance D lines which method comprises:

energizing said lamp by electrical pulses producing approximately said rated power input, said pulses having repetition rates of more than 500 Hz and a time-duration short enough to produce, in addition to the light resulting from the self-reversal and broadening of the sodium D lines, substantial light in the blue-green side of the spectrum whereby the color temperature is increased.

11. The method of claim 10 wherein the repetition rate is not over about 2000 Hz.

12. The method of claim 10, wherein the repetition rate is not over about 2000 Hz and the duty cycle is from 10 to 35%.

13. In combination, a high pressure metal vapor lamp of a kind having a filling of sodium within an envelope provided with spaced electrodes and proportioned to produce, at a rated power input, a sodium vapor pressure causing self-reversal and broadening of the sodium resonance D lines, and means for energizing said lamp comprising a generator of electrical pulses connected across said electrodes, said generator producing approximately said rated power input, said pulses having a rise rapid enough and a time-duration short enough to produce, in addition to the light resulting from the self-reversal and broadening of the sodium D lines, substantial light in the blue-green side of the spectrum whereby the color temperature is increased.

14. The combination of claim 13 wherein the time-duration of the pulses is short enough that the light on the blue-green side of the spectrum which is emitted immediately following the start of a pulse is a substantial portion of the light produced by the lamp.

15. The combination of claim 13 wherein the pulses are so proportioned in time-duration and current amplitude that the light emitted on the blue-green side of the spectrum immediately following the start of a pulse is a substantial portion of the light produced by the lamp and no appreciable rise in the red wing of the sodium D lines is produced.

16. The combination of claim 13 wherein the current-amplitude of the pulses is large enough to cause substantial production of light in the blue-green side of the spectrum whereby the color temperature is increased.

17. The combination of claim 13 wherein the current-amplitude of the pulses is large enough to cause substantial production of light in the blue-green side of the spectrum accompanied by suppression of light in the yellow-red side of the spectrum whereby the color temperature is increased.

18. The combination of claim 13 wherein the current-amplitude of the pulses is large enough to cause substantial emission of lines by highly excited sodium atoms and a continuum in the blue-green.

19. The combination of claim 13 wherein the lamp contains mercury in addition to sodium and wherein the current-amplitude of the pulses is large enough to cause substantial emission of lines by highly excited sodium atoms and by mercury atoms and a continuum in the blue-green.

20. The combination of claim 13 wherein the pulses are short enough in time-duration to produce sufficient light in the blue-green side of the spectrum to raise the color temperature to at least 2300° K.

21. The combination of claim 13 wherein the pulses have a time-duration and a current-amplitude achieving a rise in color temperature of at least 400° K. over the color temperature of the lamp under conventional operation at said rated power, and an efficacy not substantially lower than 20% below said conventional operation.

22. In combination, a high pressure metal vapor lamp of a kind having a filling of sodium within an envelope provided with spaced electrodes and proportioned to produce, at a rated power input, a sodium vapor pressure causing self-reversal and broadening of the sodium resonance D lines, and means for energizing said lamp comprising a generator of electrical pulses connected across said electrodes, said generator producing approximately said rated power input, said pulses having repetition rates of more than 500 Hz and a time-duration short enough to produce, in addition to the light resulting from the self-reversal and broadening of the sodium D lines, substantial light in the blue-green side of the spectrum whereby the color temperature is increased.

23. The combination of claim 22 wherein the repetition rate is not over about 2000 Hz.

24. The combination of claim 22 wherein the repetition rate is not over about 2000 Hz and the duty cycle is from 10 to 35%.

25. A circuit for operating a high pressure metal vapor lamp of a kind having a filling of sodium within an envelope provided with spaced electrodes and proportioned to produce, at a rated power input, a sodium vapor pressure causing self-reversal and broadening of the sodium resonance D lines, comprising connector means for making connections to the electrodes of said lamp, and means for energizing said lamp comprising a generator of electrical pulses connected across said connector means, said generator providing approximately said rated power input, said pulses having a rise rapid enough and a time-duration short enough to produce, in addition to the light resulting from the self-reversal and broadening of the sodium D lines, substantial light in the blue-green side of the spectrum whereby the color temperature of said lamp is increased.

26. The circuit of claim 25 wherein the time-duration of the pulses is short enough that the light on the blue-green side of the spectrum which is emitted immediately following the start of a pulse is a substantial portion of the light produced by the lamp.

27. The circuit of claim 25 wherein the pulses are so proportioned in time-duration and current amplitude that the light emitted on the blue-green side of the spectrum immediately following the start of a pulse is a substantial portion of the light produced by the lamp and no appreciable rise in the red wing of the sodium D lines is produced.

28. The circuit of claim 25 wherein the current-amplitude of the pulses is large enough to cause substantial production of light in the blue-green side of the spectrum whereby the color temperature is increased.

29. The circuit of claim 25 wherein the current-amplitude of the pulses is large enough to cause substantial production of light in the blue-green side of the spectrum accompanied by suppression of light in the yellow-red side of the spectrum whereby the color temperature is increased.

30. The circuit of claim 25 wherein the current-amplitude of the pulses is large enough to cause substantial emission of lines by highly excited sodium atoms and a continuum in the blue-green.

31. The circuit of claim 25 wherein the lamp contains mercury in addition to sodium and wherein the current-amplitude of the pulses is large enough to cause substantial emission of lines by highly excited sodium atoms and by mercury atoms and a continuum in the blue-green.

32. The circuit of claim 25 wherein the pulses are short enough in time-duration to produce sufficient light in the blue-green side of the spectrum to raise the color temperature to at least 2300° K.

33. The circuit of claim 25 wherein the pulses have a time-duration and a current-amplitude achieving a rise in color temperature of at least 400° K. over the color temperature of the lamp under conventional operation at said rated power, and an efficacy not substantially lower than 20% under said conventional operation.

34. A circuit for operating a high pressure metal vapor lamp of a kind having a filling of sodium within an envelope provided with spaced electrodes and proportioned to produce, at a rated power input, a sodium vapor pressure causing self-reversal and broadening of the sodium resonance D lines, comprising connector means for making connections to the electrodes of said lamp, and means for energizing said lamp comprising a generator of electrical pulses connected across said connector means, said generator providing approximately said rated power input, said pulses having repetition rates of more than 500 Hz and a time-duration short enough to produce, in addition to the light resulting from the self-reversal and broadening of the sodium D lines, substantial light in the blue-green side of the spectrum whereby the color temperature of said lamp is increased.

35. The circuit of claim 34 wherein the repetition rate is not over about 2000 Hz.

36. The circuit of claim 34 wherein the repetition rate is not over about 2000 Hz and the duty cycle is from 10 to 35%.

37. The method of claim 10 wherein substantially no keep-alive current is supplied to the lamp between pulses.

38. The combination of claim 22 wherein said generator provides substantially no keep-alive current to the lamp between pulses.

39. The circuit of claim 34 wherein said generator provides substantially no keep-alive current to the lamp between pulses.

* * * * *